United States Patent [19]

Zaruba et al.

[11] 4,448,421

[45] May 15, 1984

[54] BOARD GAME HAVING APERTURED, MARKER-RECEIVABLE PLAYING PIECES

[75] Inventors: John V. Zaruba, Chicago; Harry Disko, South Barrington, both of Ill.

[73] Assignee: Marvin Glass & Associates, Chicago, Ill.

[21] Appl. No.: 339,850

[22] Filed: Jan. 18, 1982

[51] Int. Cl.[3] ..... A63F 3/00

[52] U.S. Cl. ..... 273/243; 273/289; 273/146

[58] Field of Search ..... 273/243, 288, 290

[56] References Cited

U.S. PATENT DOCUMENTS 4,159,117 6/1979 Kuna ..... 273/243

4,174,840 11/1979 Curtiss ..... 273/243

*Primary Examiner*—Richard C. Pinkham

*Assistant Examiner*—Matthew L. Schneider

[57] ABSTRACT

A board game device includes a playing board which defines a playing surface upon which a plurality of markers are arranged in a pattern. First and second distinguishable playing pieces are also locatable upon the playing surface at any of the locations at which a marker is locatable as well as upon unique additional playing positions. A chance selection device determines whether a player must utilize either the first or second playing piece in that turn and an additional chance selection devices determines the amount of movement undertaken by the selected playing piece. Movement of the first playing piece along the playing surface enables the player to collect the various markers along its path within the playing piece. This is accomplished by engaging the markers such that the markers are forced through a valved slot in one surface of the playing piece. The first playing piece also has a pivoted foot which enables a portion of the playing piece to be pivoted away from a marker received within the foot and then pivoted downwardly to force the marker into the playing piece. The second playing piece is capable of "capturing" the first playing piece upon coincident occupation of the same playing position.

9 Claims, 5 Drawing Figures

BOARD GAME HAVING APERTURED, MARKER-RECEIVABLE PLAYING PIECES

BACKGROUND OF THE INVENTION

1. Field of the Invention

This invention relates generally to board game devices and particularly to such devices which enable various members to be captured in the course of a game.

2. Brief Description of Background Art

A wide variety of board game devices which enable competition between one or more players are well known in the art. Often these board game devices involve the symbolic capture of one player's playing pieces by another player. These games are highly enjoyable since the interplay between the players is heightened by the symbolic action involved in the play of the game.

Currently electronic video games are enjoying a great deal of entertainment attention. These games are capable of highly realistic visual and audio effects and therefore have enjoyed considerable success. One such video game, marketed under the mark PAC-MAN, involves a maze-like video image upon which jaw shaped images scurry about collecting video images in their path in a chewing action. The jaw shaped images can consume ghost images for added point collection and at appropriate times can be consumed by the same ghost images. While this game has enjoyed considerable success, it also entails concommittant expense for its players. While the potential enjoyment certainly is considered a worthwhile investment for many players, it would be desirable to provide such a game in a less expensive format.

SUMMARY OF THE INVENTION

It is a primary object of the present invention to provide a board game device capable of entertaining action, comparable to that enjoyed by many video games.

This and other objects of the present invention are achieved by a board game including a playing surface with a plurality of markers positionable on the playing surface in a pattern. First and second playing pieces bearing an indicating means for distinguishing the playing pieces are also positionable on the playing surface. A first playing piece is adapted to receive the markers within the interior of the playing piece upon engagement of the markers by the first playing piece. Chance selection means determines the extent of movement of the playing piece over the playing surface.

DETAILED DESCRIPTION OF THE PREFERRED EMBODIMENT

Figure 1:
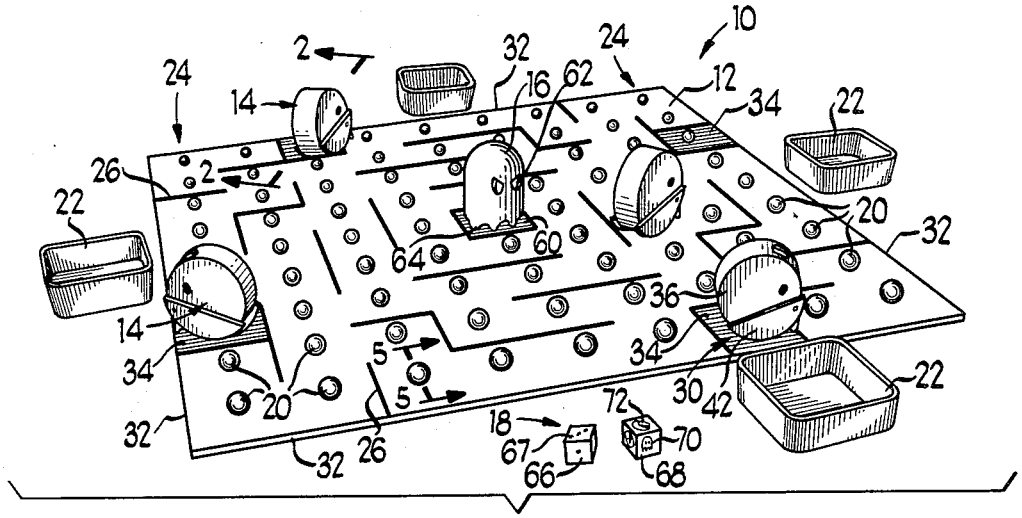
FIG. 1 is a perspective view of one embodiment of the present invention.
Figure 5:
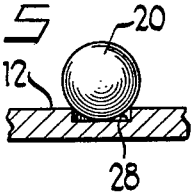
FIG. 5 is an enlarged cross-sectional view taken generally along line 5—5 in FIG. 1.

Referring to the drawing wherein like reference characters are used for like parts throughout the several views, a board game device generally designated by the reference numeral 10, shown in FIG. 1, includes a playing surface 12, a plurality of first playing pieces 14, a second playing piece 16, a chance selection device 18, a plurality of markers 20 and a plurality of marker containers 22. The playing surface 12 includes a plurality of playing positions marked either by a marker 20, a first playing piece 14, or a second playing piece 16. The markers 20, are conveniently small balls or marbles arranged in a plurality of marker rows 24. The playing surface 12 preferably includes a plurality of indicia 26 which define a playing path composed of adjacent playing positions marked by the markers 20. Conveniently the playing path is a maze-like pattern which extends erratically along and between the rows 24. Conveniently the markers 20 are secured in the playing position by a depression 28 in the surface 12, as indicated in FIG. 5.

The set of first playing pieces 14, including four such pieces 14 in the illustrated embodiment but conveniently any desired number of pieces 14 may be utilized, are each initially located on a home playing position 30. The home playing positions 30 are conveniently each located along a different edge 32 of the playing surface 12 so as to maintain an initial spacing between the various pieces 14. As shown in FIG. 1, the home playing positions 30 are indicated by indicia 34 placed on the playing surface 12 at the appropriate location.

Figure 2:
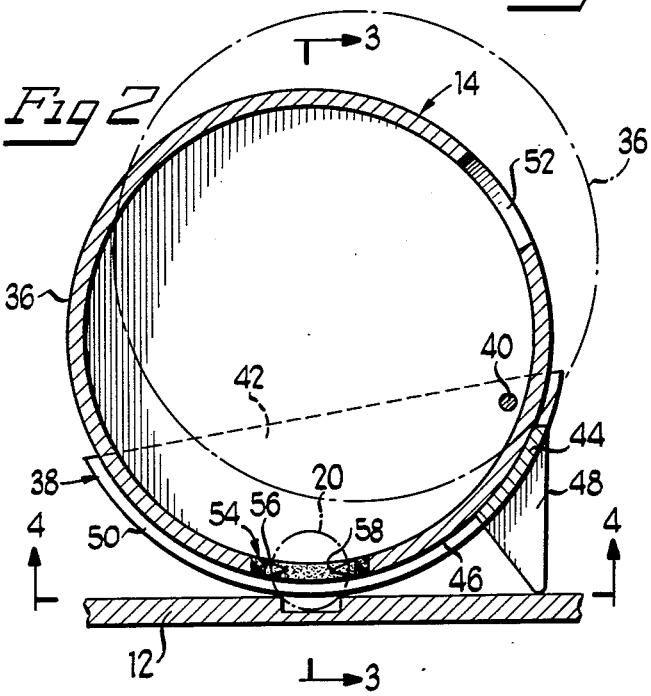
FIG. 2 is an enlarged cross-sectional view taken generally along the line 2—2 in FIG. 1.
Figure 3:
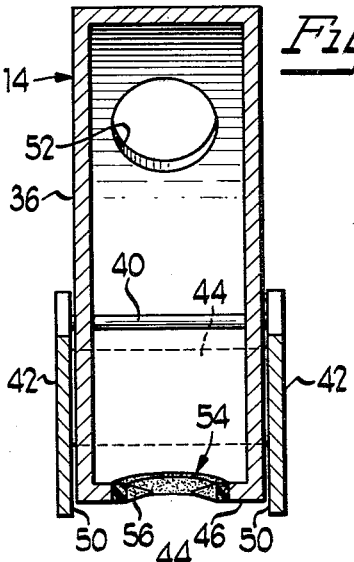
FIG. 3 is a cross-sectional view taken generally along the line 3—3 in FIG. 2.
Figure 4:
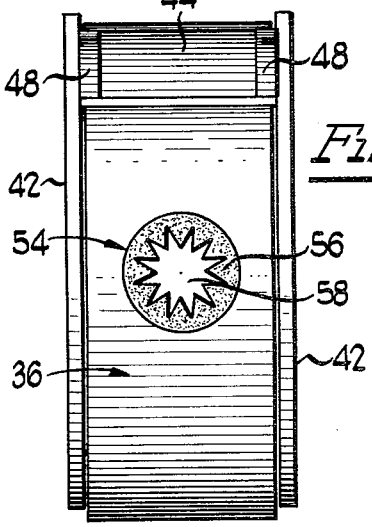
FIG. 4 is a cross-sectional view taken generally along the line 4—4 in FIG. 2.

As shown in FIGS. 2 and 3, the playing pieces 14 conveniently have a generally disc-like shape with a hockey puck-shaped portion 36 and a generally conforming, U-shaped base 38 which is pivotally connected to the portion 36, conveniently along the periphery of the portion 36, using an axle 40. The U-shaped base 38 is made up of a pair of conveniently somewhat semi-circular arms 42 which conform generally to the sides of the portion 36 and are connected by a cross-piece 44, shown in FIG. 4, which conveniently conforms to the exterior shape of the peripheral edge 46 of the portion 36. Conveniently the cross-piece 44 is spaced from the point of contact between the playing piece 14 and the surface 12 and a pair of outwardly extending feet 48 extend from the cross-piece 44 to the playing surface 12. Conveniently the arms 42 extend slightly beyond the peripheral edge 46 of the portion 36 so that the portion 36 is in fact supported by the playing surface 12 atop the outwardly extending portions 50 of the arms 42 as well as on the feet 48.

The peripheral edge 46 of the portion 36 includes a pair of access ports 52 and 54. The access port 52, which functions as an outlet, is conveniently spaced from the point of contact between the piece 14 and the playing surface 12. The access port 54 is located directly at the point of contact with the playing surface 12, spaced slightly therefrom due to the imposition of portions 50. The access port 54 receives a valve member 56, conveniently an apertured resilient insert with a star-like central aperture 58. The aperture 58 is of sufficient size to receive a marker 20 and to permit the marker to be forced with some effort into the hollow interior of the portion 36. Once inside the portion 36, the marker 20 does not exit through the access port 54. However, the access port 52 is of sufficient size to enable the markers to be removed therefrom by turning the playing piece 14 upside down.

Conveniently only one second playing piece 16 is utilized, positioned at a playing position marked by indicia 60 approximately at the center of the playing surface 12. The playing piece 16 in the illustrated embodiment is generally dome-shaped with a pair of eyes 62 and an undulating playing surface contacting edge 64, lending a ghost-like appearance to the playing piece 16.

The chance selection device 18 is conveniently a pair of cubes 66 and 68 having the size and feel associated with conventional dice. The cube 66 may be a conventional die having indicia 67 on its side for indicating the numbers from 1 to 6. However, the cube 68, of similar size and shape, bears different indicia 70 and 72 corresponding to the first and second playing pieces 14, 16. As shown in FIG. 1, the indicia 70 is a likeness of the playing piece 16 while the indicia 72 is a likeness of a playing piece 14. In one embodiment of the present invention, half the sides of the cube 68 bear the indicia 70 while the other half bear the indicia 72. Thus the probability of one or the other of the indicia 70, 72 being the upwardly facing indicia is 50–50.

The board game device 10 is played as follows. Initially, the playing pieces 14 are positioned atop the indicia 34 along each edge 32 of the playing surface 12 with each player assigned one or more playing pieces 14. A playing piece 16 is located centrally on the playing surface 12 atop the indicia 60. The various markers 20 are located in a plurality of rows 24 each received within a depression 28 in the playing surface 12. The first player operates the chance device 18 by rolling the cubes 66 and 68 along a surface. The upwardly facing side of each cube 66 and 68 indicates the player's movement for that turn. The cube 66 indicates the number of positions to be moved by the player and the cube 68 indicates whether the player is to move his or her playing piece 14 or the playing piece. If the upwardly facing indicia on the cube 68 is the indicia 70 corresponding to the playing piece 16, the player must declare which opponent he or she intends to pursue. Only opponents whose playing pieces 14 are not located atop the home playing position 30 may be pursued. If a player captures an opponent by moving his playing piece 14 over the location occupied by the opponent's playing piece 14, the player receives three of the opponent's markers 20 and the opponent returns to his or her home playing position 30. The playing piece 16 remains at the position formerly occupied by the opponent.

If the player controlling the playing piece 16 is unable to capture an opponent on the first try, the opponent then rolls the cube 66 and moves his or her playing piece 14 the number of times indicated by the upwardly facing indicia on the cube 66. If the opponent is able to move off the playing surface 12, moving one playing position at a time and not crossing the indicia 26, the opponent has escaped. However, if the opponent is unable to escape, the player who formerly moved the playing piece 16 has a second roll to againtry to capture the opponent in the same manner. If the player again fails to capture the opponent his or her turn is over.

If upon the initial roll, the indicia 72 faces upwardly the player moves his or her playing piece 14 the number of positions indicated by the cube 66. The player may not cross the indicia 26, but at each playing position along the player's path of movement the player may capture a marker 20. A marker is conveniently captured by pivoting the portion 36 away from the playing surface 12, for example to the position indicated in dashed lines in FIG. 2, and locating the marker 20 to be captured between the arms 42 of the base 38. The portion 36 is then pivoted downwardly so that the access port 54 encircles the marker 20, indicated in dashed lines in FIG. 2, causing the marker to be forced into the interior of the portion 36 through the valve member 56. This capturing action amusingly simulates a chewing or eating action. The marker 20 can be removed from the interior of the portion 36 through the access port 52 and retained within the player's marker container 22.

Play continues from player to player in the manner described until all the markers 20 have been captured. The player who has captured the most markers 20 is the winner.

The foregoing detailed description has been given for clearness of understanding only and no unnecessary limitations should be understood therefrom as many modifications will be obvious to those skilled in the art.

What is claimed and sought to be secured by Letters Patent of the United States is:

1. A board game device comprising:

a playing surface;

a plurality of markers positionable on said playing surface;

a first playing piece adapted to receive said markers within the interior of said playing piece upon engagement of one of said markers by said first playing piece;

said first playing piece including a first portion contacting the playing surface and a second portion supported atop of said playing surface by said first portion;

an opening in one of said portions for receiving a marker within the interior of said first playing piece; and said first and second portions being pivotally connected for relative movement such that said second portion is movable away from said playing surface and back downwardly toward said playing surface so as to capture a marker within its interior by forcing the marker through said opening.

2. The board game device of claim 1 wherein said second portion includes a valve member for retaining a marker within the interior of said playing piece.

3. The board game device of claim 2 wherein said valve member is an apertured resilient member, said aperture having a interior size slightly less than the exterior size of said marker.

4. The board game device of claim 2 wherein said first playing piece includes an access port for removing said markers captured within the interior of said playing piece.

5. The board game of claim 1 wherein:

a second playing piece is movable on said playing surface to capture said first playing piece; and chance selection means for determining the extent of movement of said playing pieces over said playing surface.

6. The board game device of claim 5 wherein said chance selection means includes means for determining which of said first or second playing pieces must be moved.

7. The board game device of claim 5 wherein said chance selection means includes a pair of dice, one of said dice bearing indicia indicating a plurality of numerals on its surfaces and the other of said dice bearing indicia on at least one surface indicating said first playing piece and indicia on at least one other surface indicating said second playing piece.

8. The board game device of claim 5 wherein said-playing surface includes a plurality of depressions for receiving said markers, said markers being in the form of spheres.

9. The board game device of claim 5 wherein the playing surface includes a plurality of playing positions indicated by said markers and arranged in a maze pattern.

* * * * *

UNITED STATES PATENT AND TRADEMARK OFFICE

CERTIFICATE OF CORRECTION

PATENT NO. : 4,448,421

DATED : May 15, 1984

INVENTOR(S) : John V. Zaruba and Harry Disko

It is certified that error appears in the above-identified patent and that said Letters Patent is hereby corrected as shown below:

Column 1, Brief Description Of The Drawing, line 62, change ";' to --.--

Column 2, line 42, insert the word --playing-- before the word "surface".

Column 3, line 32, insert the number --16-- after the word "piece".

Column 3, line 52, change "againtry" to --again try--.

Signed and Sealed this

*Fifteenth* Day of *January 1985*

[SEAL]

*Attest:*

*Attesting Officer*

GERALD J. MOSSINGHOFF

*Commissioner of Patents and Trademarks*